US009458666B2

(12) United States Patent
Murray

(10) Patent No.: US 9,458,666 B2
(45) Date of Patent: Oct. 4, 2016

(54) TENSION ADJUSTABLE RETRACTABLE SCREEN ASSEMBLY

(71) Applicant: Michael Murray, Jacksonville, FL (US)

(72) Inventor: Michael Murray, Jacksonville, FL (US)

( * ) Notice: Subject to any disclaimer, the term of this patent is extended or adjusted under 35 U.S.C. 154(b) by 8 days.

(21) Appl. No.: 14/634,165

(22) Filed: Feb. 27, 2015

(65) Prior Publication Data

US 2015/0240551 A1 Aug. 27, 2015

Related U.S. Application Data

(60) Provisional application No. 61/945,472, filed on Feb. 27, 2014.

(51) Int. Cl.
*E06B 9/58* (2006.01)

(52) U.S. Cl.
CPC ..... *E06B 9/581* (2013.01); *E06B 9/582* (2013.01); *Y10T 16/3797* (2015.01)

(58) Field of Classification Search
CPC ..... E06B 2009/587; E06B 2009/581; E06B 2009/543; E06B 9/581; E06B 9/58; E06B 9/521; B44D 3/185
USPC ..... 160/272, 328, 378; 49/417, 414, 452; 16/87 R, 96 R
See application file for complete search history.

(56) References Cited

U.S. PATENT DOCUMENTS

| | | | | |
|---|---|---|---|---|
| 2,608,251 | A * | 8/1952 | Heintzel | E06B 9/52 160/378 |
| 3,152,354 | A * | 10/1964 | Diack | E05D 15/0652 16/105 |
| 8,191,606 | B2 * | 6/2012 | Edlin | E06B 9/52 160/328 |
| 2011/0108214 | A1 * | 5/2011 | Komatsu | E06B 9/13 160/272 |
| 2012/0012260 | A1 * | 1/2012 | Elinson | E06B 9/42 160/240 |
| 2012/0325416 | A1 * | 12/2012 | Hayashiguchi | E06B 9/581 160/272 |
| 2014/0076507 | A1 * | 3/2014 | Dibben | E06B 9/58 160/272 |
| 2015/0240551 | A1 * | 8/2015 | Murray | E06B 9/581 16/96 D |
| 2015/0345215 | A1 * | 12/2015 | Roberts | E06B 9/42 160/368.1 |

FOREIGN PATENT DOCUMENTS

EP -2085560 * 8/2009

* cited by examiner

*Primary Examiner* — Blair M Johnson
(74) *Attorney, Agent, or Firm* — Thomas C. Saitta

(57) ABSTRACT

A screen track assembly for mounting and tensioning a retractable screen across an opening, the assembly having a generally U-shaped outer track member having an opening; an inner track member received within the outer track member, the inner track member adapted to receive a retractable screen, the inner track member being movable relative to the outer track member; biasing members to present a biasing force to extend the inner track member toward the opening of the outer track member; and adjustable mechanical fasteners to fix the position of the inner track member relative to the outer track member such that the screen may be tightened or loosened as required for proper functionality.

20 Claims, 7 Drawing Sheets

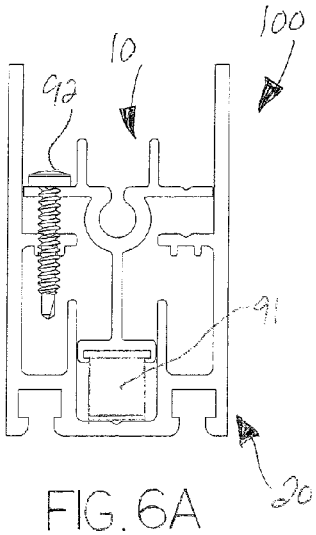
FIG. 6A
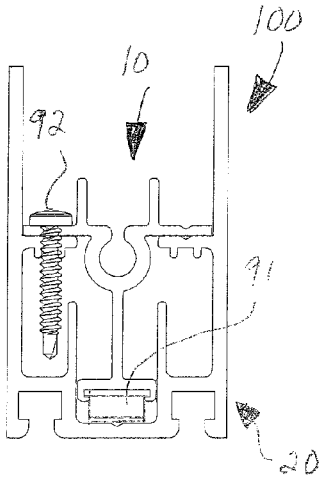
FIG. 6B
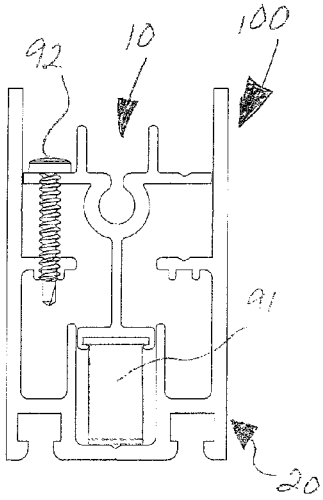
FIG. 6C
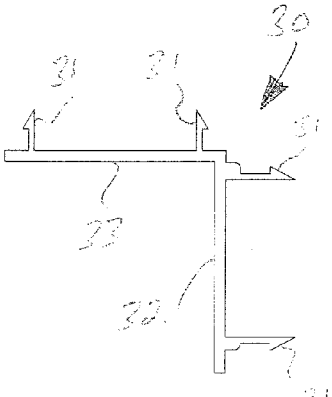
FIG. 10
FIG. 9
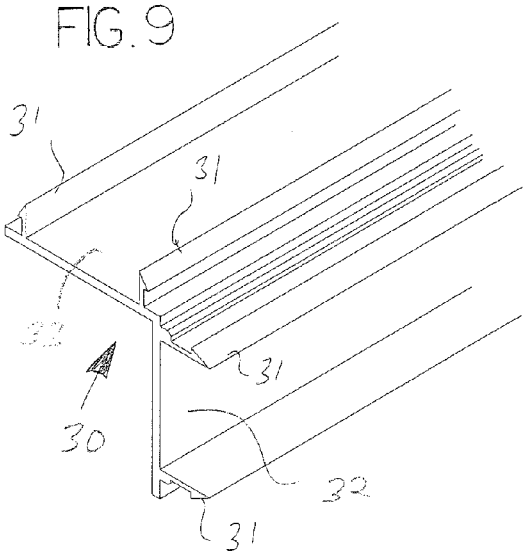

FIG. 7
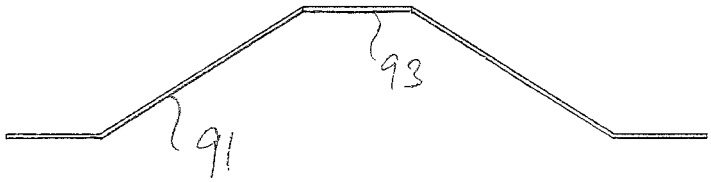
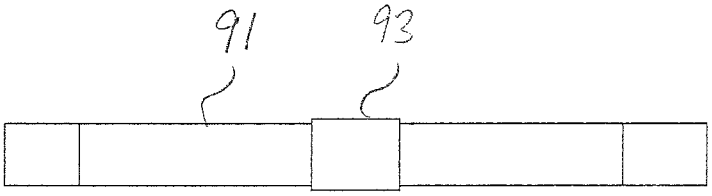
FIG. 8

TENSION ADJUSTABLE RETRACTABLE SCREEN ASSEMBLY

This application claims the benefit of U.S. Provisional Patent Application Ser. No. 61/945,472, filed Feb. 27, 2014, the disclosure of which is incorporated herein by reference.

BACKGROUND OF THE INVENTION

This invention relates in general to assemblies and methods of retaining and guiding a retractable screen in an extruded guide track affixed to a fixture or building, or to another fixed guide track. More particularly, the invention relates to such assemblies and methods that are adjustable to increase or decrease tension on the retractable screen.

Guiding a screen in a track system is typically accomplished by forming an enlarged edge or bead on opposing sides of the screen and positioning the screen bead within complimentary receiving channels formed within an extruded track, such that the bead is held within opposing track sections in a manner that allows the screen to travel up and down the tracks, the bead and track assembly in combination forming an end retention system to retain the screen under the proper tension. Such an assembly also creates a seal around the screen edges that prevents insects, light, wind and other elements from entering the screened area. Attaching a screen track system to a fixture or building is typically accomplished by directly affixing the track to the fixture or building with mechanical fasteners.

The track assembly must be sized within a very narrow tolerance or the screen will not work properly. If the screen is pulled too tight, friction will prevent it from sliding within the track, and if it is too loose it will have a poor appearance. The process of manufacturing a track assembly is not accurate enough to meet the tolerance requirements on its own to achieve a proper fit once installed. As a result, it has become common practice to provide a track assembly that allows for inward and outward adjustment to adjust the screen tension between the installed tracks. Typically, a track assembly is comprised of paired extruded members, an inner track member and an outer track member, wherein the outer track member is fixed directly to the building and the inner track member is received within the outer track member in a manner that allows the inner track member to be adjusted to provide greater or lesser tension on the screen to compensate for irregularities in the building and slight variations in screen dimensions that occur during manufacture.

While tension adjustable track assemblies are known in the art, these assemblies are difficult to adjust and typically require professional levels of skill One current method employs an outer channel track with ratchet shaped grooves on the inner surface that engage an inner track with corresponding cogs on the outer surface, with mechanical fasteners to lock the assembly in place. With the outer track installed, the inner track is pushed into the outer track until the screen is properly tensioned, the ratchet teeth and cogs engaging as the track is pushed in such that the inner track is firmly held in its position and cannot be withdrawn without disassembly and special tools. A mechanical fastener is then driven through the two tracks to keep the track from moving further outward. While this presents an effective means for tensioning the screen, this system does not provide an easy means to re-adjust the assembly to release tension from the screen, which may be required when the screen will no longer slide easily within the tracks or the screen gets stuck as a result of shrinkage, settling of the building, temperature changes or other reasons.

It is desirable for the professional to be able to install a retractable screen system as quickly as possible. In many cases, however, a building is constructed in a manner that makes fast installation challenging, as the building may have openings that are out of square or out of plumb, or have irregular surface finishes such as siding, stonework, brick, or stucco. Additionally, a building may have another type of track system or fixture already in place on the same opening where an additional screen track is to be mounted. This is common in hurricane zones, where a hurricane shutter track is mounted onto the building across the opening and a screen track would therefore need to be attached to the hurricane shutter track. While a skilled professional can modify, fabricate, and build suitable track systems as necessary to accommodate the requirements of the job, it is time consuming and expensive.

It is an object of this invention to provide a screen track assembly that incorporates a structure and method to easily adjust the tension on the screen after installation, whether to tighten or loosen, without requiring professional service, disassembly, or specialized tools. It is a further object to provide a screen track assembly that has a compatible adaptor such that the screen track assembly can be attached to an auxiliary track or building component, such as that of a hurricane shutter or window frame, or where the adapter is designed to overcome a construction irregularity.

Other objects and advantages of the present invention include:

(1) To provide a screen track assembly that is adjustable.
(2) To provide a screen track assembly that has an adjustable inner track member received within a fixed outer track member.
(3) To provide a screen track assembly that incorporates a spring to assist in adjusting tension.
(4) To provide a screen track assembly that can be adjusted by non-skilled individuals.
(5) To provide a screen track assembly that incorporates at least one mating channel.
(6) To provide a screen track assembly that works with adapters to fit to other track systems or building components.
(7) To provide a screen track assembly that works with adapters to solve construction irregularities.
(8) To provide a device that is modular, and can be used in part, as a whole, or in combination with other devices.
(9) To provide a screen track assembly that is durable and weather resistant.
(10) To provide a device that is inexpensive to manufacture.

BRIEF SUMMARY OF THE INVENTION

In general the invention comprises in various embodiments a screen track assembly for mounting and tensioning a retractable screen across an opening, the assembly comprising a generally U-shaped outer track member having an inward-facing opening, an inner track member received within the outer track member, the inner track member adapted to retain a retractable screen, the inner track member being movable relative to the outer track member, biasing members to present a biasing force to extend the inner track member toward the opening of the outer track member; and adjustable mechanical fasteners to fix the position of the inner track member relative to said outer track member such that combination of the fasteners and the biasing members enables the screen to be tightened or loosened as required for proper functionality. In further embodiments, the invention comprises adaptors that enable the outer track member to be affixed to various building surfaces or auxiliary track.

In alternative language, the invention is a screen track assembly adapted to mount a retractable screen across an opening, the assembly comprising a generally U-shaped outer track member having an opening; an inner track member received within said outer track member, said inner track member adapted to retain a retractable screen, the position of said inner track member relative to said outer track member being adjustable to adjust the tension on the retractable screen; biasing members to present a biasing force to extend said inner track member toward said opening of said outer track member; and adjustable mechanical fasteners to fix the position of said inner track member relative to said outer track member.

Additionally, the invention is a screen track assembly comprising a generally U-shaped outer track member comprising an outer face member, two parallel exterior walls, an opening and mating flanges extending from said exterior walls; an inner track member positioned within said outer track member, the position of said inner track member within said outer track member being adjustable, said inner track member comprising a bead channel, a pair of mounting fins, and a rail member; a screen comprising a bead, said bead being retained within said bead channel in a manner whereby said bead is axially movable within said bead channel; biasing members positioned between said inner track member and said outer track member to present a biasing force to extend said inner track member toward said opening of said outer track member; and adjustable mechanical fasteners connecting said mounting fins of said inner track member to said mating flanges of said outer track member, whereby the combination of said biasing members and said adjustable mechanical fasteners fix the position of said inner track member relative to said outer track member in an adjustable manner to properly tension said screen.

BRIEF DESCRIPTION OF THE DRAWINGS

FIGS. 6A, 6B and 6C show the assembled track assembly of FIG. 5 as adjusted for an intermediate, fully tensioned and fully relaxed configuration, respectively.

FIG. 7 is a side view of an embodiment of the spring member.

FIG. 8 is a top view of the spring member embodiment of FIG. 7.

FIG. 9 is a perspective view of an embodiment of the track adaptor.

FIG. 10 is an end view of the track adaptor embodiment of FIG. 9.

DETAILED DESCRIPTION OF THE INVENTION

Figure 2:
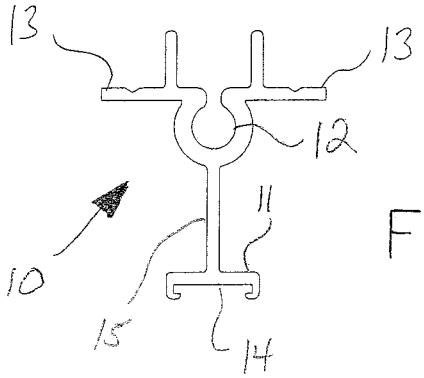
FIG. 2 is an end view of the inner track member embodiment of FIG. 1.

This invention, as described and shown in the drawings in various embodiments that are not meant to be limiting, is in general a tension adjustable retractable screen assembly, the assembly being a screen track assembly 100 comprised of paired extruded aluminum profiles, an inner track member 10 and an outer track member 20, springs 91, and adjusting fasteners 92 that interact to allow easy adjustment of the retractable screen. The inner track member 10 is structured to receive the peripheral bead or edge structure of a retractable screen such as used in covering an opening to prevent passage of insects, debris, light, etc. The inner track member 10 is received by and cooperatively mates in adjustable manner with the outer track member 20, which is typically affixed directly to the inward facing side of an opening in a building. The assembly 100 may further comprise an adaptor member 30 to allow the screen track assembly 100 to be affixed to other extruded aluminum profiles, such as another track member 40 already affixed to an opening, to a lateral face or wall of a building, or to compensate for irregularities in the mounting surface.

Figure 4:
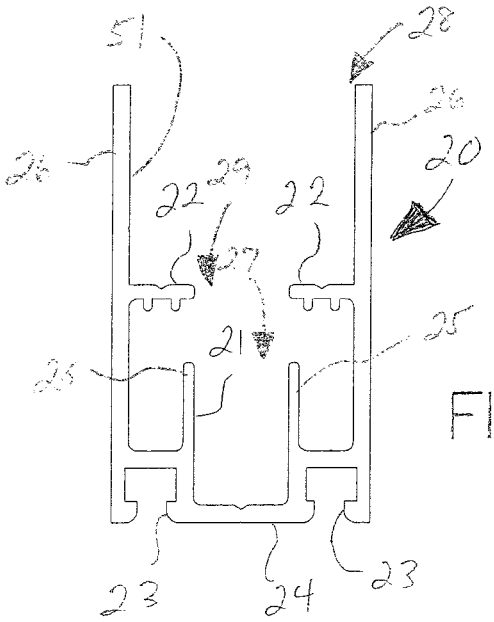
FIG. 4 is an end view of the outer track member embodiment of FIG. 3.
Figure 3:
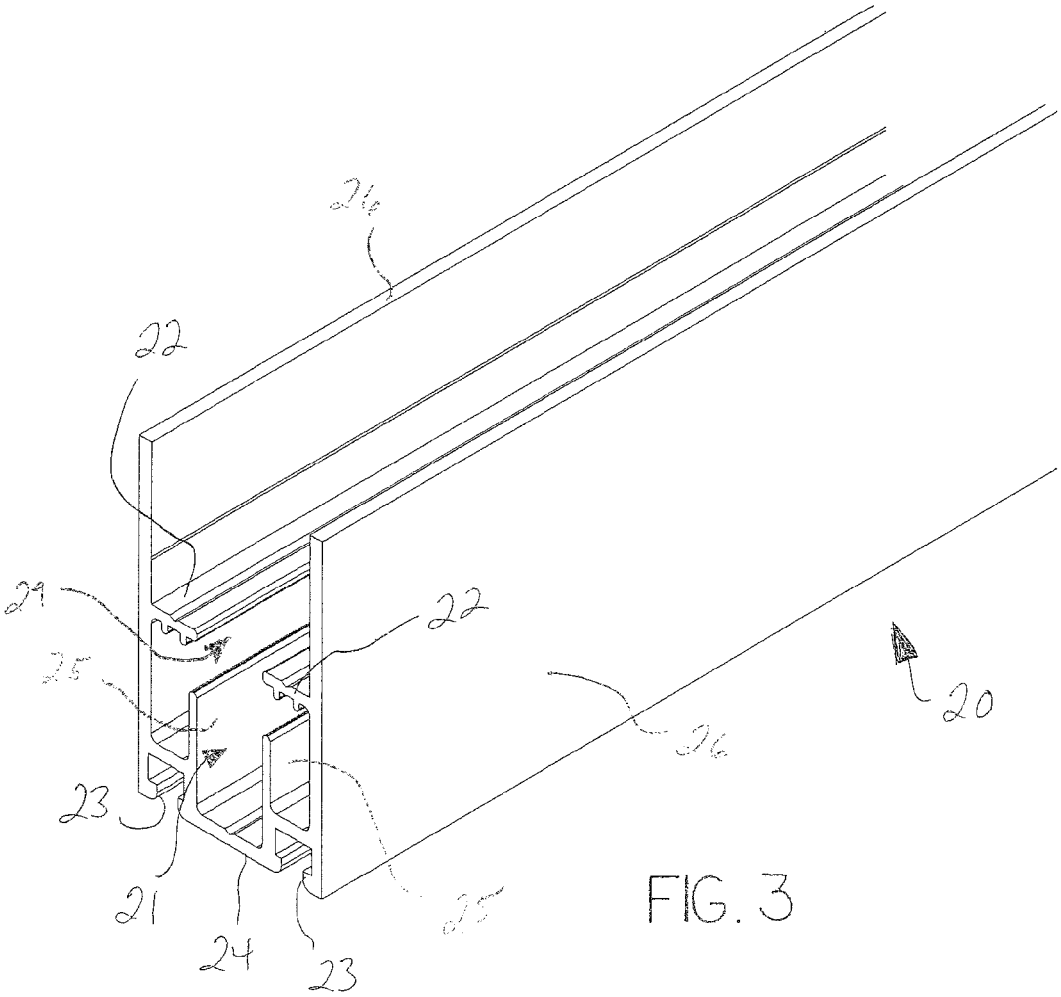
FIG. 3 is a perspective view of an embodiment of the outer track member of the screen track assembly.

The outer track member 20, an embodiment of which is shown best in FIGS. 3 and 4, forms the affixed and static base for the screen track assembly 100. It is preferred that the outer track member 20 be generally U-shaped in cross-section such that the inner track member 10 and screen 60 is received through the inwardly facing opening 28 of the "U". The outer track member 20 comprises two parallel exterior walls 26 (the legs of the "U") and an outer face member 24 (the base of the "U") joined to the two exterior walls 26. The outer track member 20 further comprises an interior guide channel 21, likewise generally U-shaped, formed by parallel interior walls 25 extending from the outer face member 24, with the opening 27 of the interior guide channel 21 defined by the two interior walls 25 facing in the same direction as the opening 28 of the outer track member 20 defined by the exterior walls 26. A mounting flange 22 extends inwardly from the middle portion of each exterior wall 26, the opposing mounting flanges 22 extending toward each other in the same plane and dimensioned so as to leave a central gap 29 between the two mounting flanges 22. The combination of the exterior walls 26 and the mounting flanges 22 defines an exterior guide channel 51, which is wider than the interior guide channel 21. The outer track members 20 are preferably extruded metal members and are affixed in known manner to opposite sides of an opening in a building or the like, typically by mechanical fasteners extending through the outer face member 24, with openings 28 facing each other.

Figure 1:
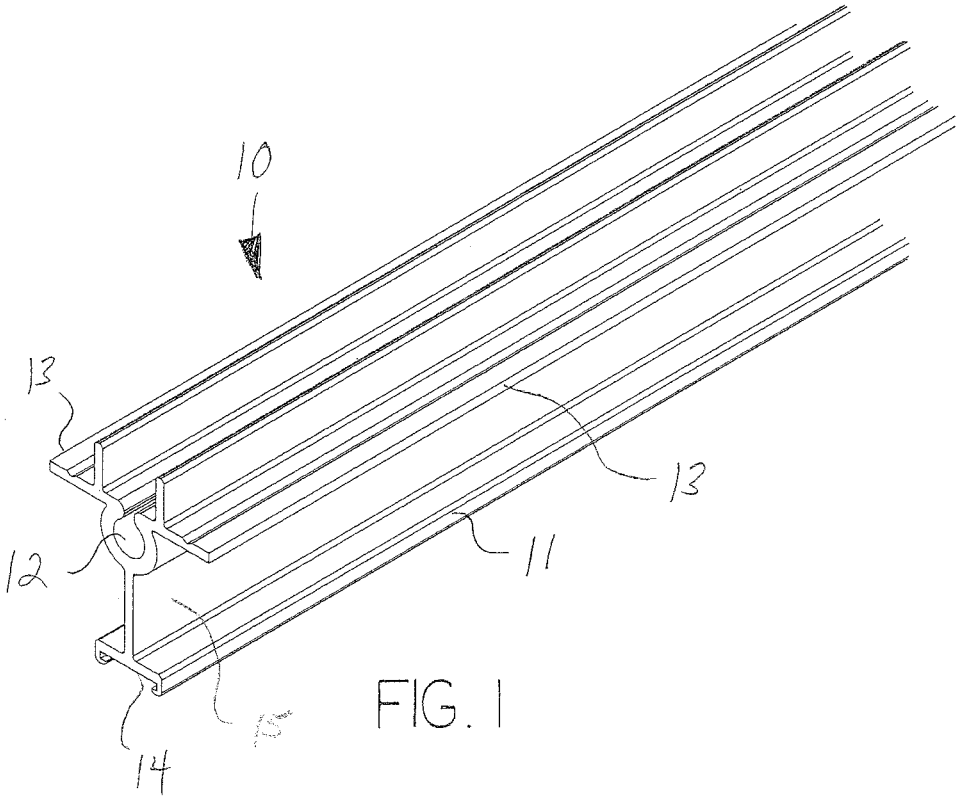
FIG. 1 is a perspective view of an embodiment of the inner track member of the screen track assembly.

The inner track member 10, an embodiment of which is shown in FIGS. 1 and 2, is the inner adjustable component of the screen track assembly 100 that is received within the outer track member 20. The size and structure of the inner track member 10 is such that it is able to be adjusted and moved in the ward and outward directions to differing positions within the outer track member 20. It is preferred that the inner track member 10 be approximately I-shaped or T-shaped in cross-section in a broad sense, and comprising a rail member 11 sized and adapted to be received within the outer track guide channel 21, the rail member 11 being mounted onto an extension flange or member 15 extending from a generally C-shaped in cross-section bead channel 12. Bead channel 12 is adapted to receive the peripheral bead 61 of the screen 60 to be positioned between the opposing outer track members 20 in a manner that allows the screen 60 to be retracted and extended along the inner track member 10, the bead 61 sliding axially within the bead channel 12. The combination of the rail member 11 and the extension member 15 is generally T-shaped in cross-section, and the width of the rail member 11 is structured to be slightly smaller than the width of the interior guide channel 21 between the interior walls 25, such that the interior guide channel 21 allows relative movement of the rail member 11 in the inward or outward direction but limits lateral movement of the rail member 11.

The inner track member 10 further comprises mounting flanges or fins 13 that extend in a single plane laterally to either side of the bead channel 12, the fins 13 serving as the abutting surface for the head of the adjusting fastener 92. The mounting fins 13 are sized such that the distance between their outer edges is only slightly smaller than the width of the exterior guide channel 51 between the opposing exterior walls 25, such that the exterior guide channel 51 limits lateral movement of the mounting fins 13. The combination of the rail member 11 and the mounting fins 13 received within the interior guide channel 21 and exterior guide channel 51 allows the inner track member 10 to be moved and adjusted inwardly and outwardly relative to the outer track member 20, while preventing the inner track member 10 from moving laterally, pivoting or rotating within the outer track member 20, such that the inner track member 10 remains in proper alignment under any tension.

In use the inner track member 10 is positioned within the outer track member 20, the rail member 11 extending through the gap 29 and beyond the mounting flanges 22 such that it resides within the interior guide channel 21 between the interior walls 25, and the mounting fins 13 residing within the external guide channel 51 between the exterior walls 26. In the embodiments as shown, the gap 29 is sized such that the bead channel 12 may pass through the gap 29 as well.

Figure 5:
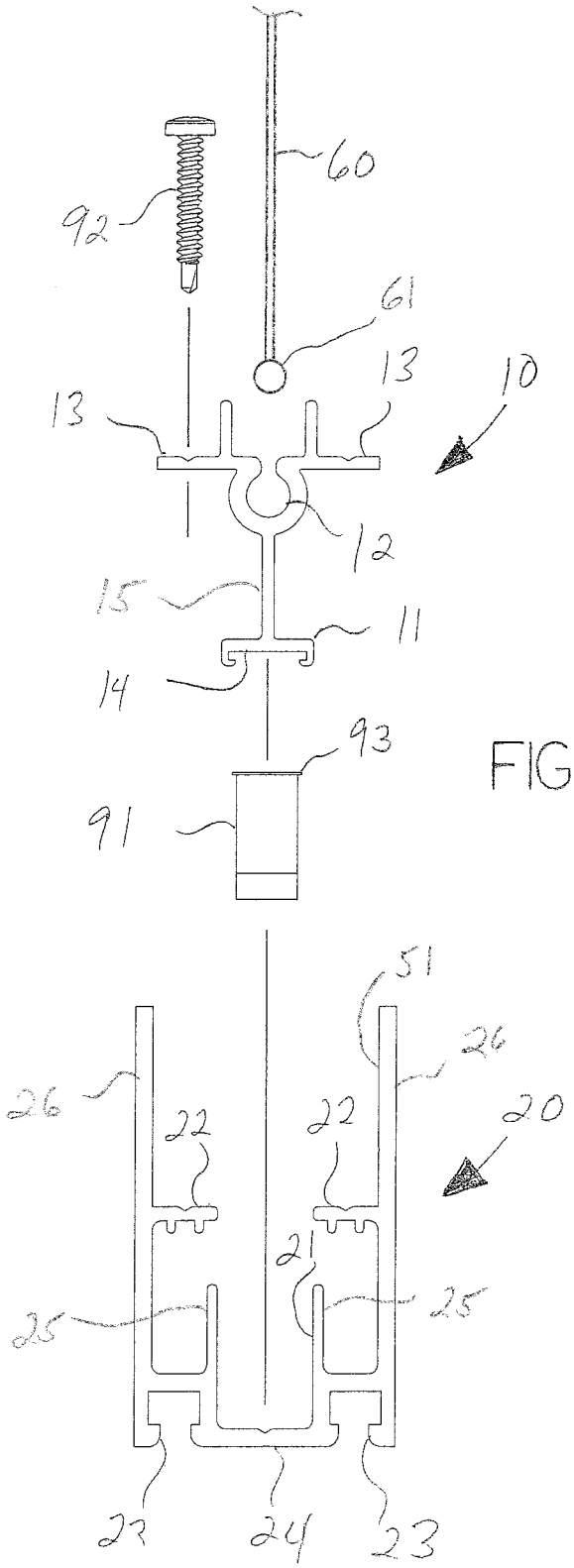
FIG. 5 is an exploded view of an embodiment of the track assembly comprising the inner track member embodiment of FIGS. 1 and 2 and the outer track member embodiment of FIGS. 3 and 4.
Figure 11:
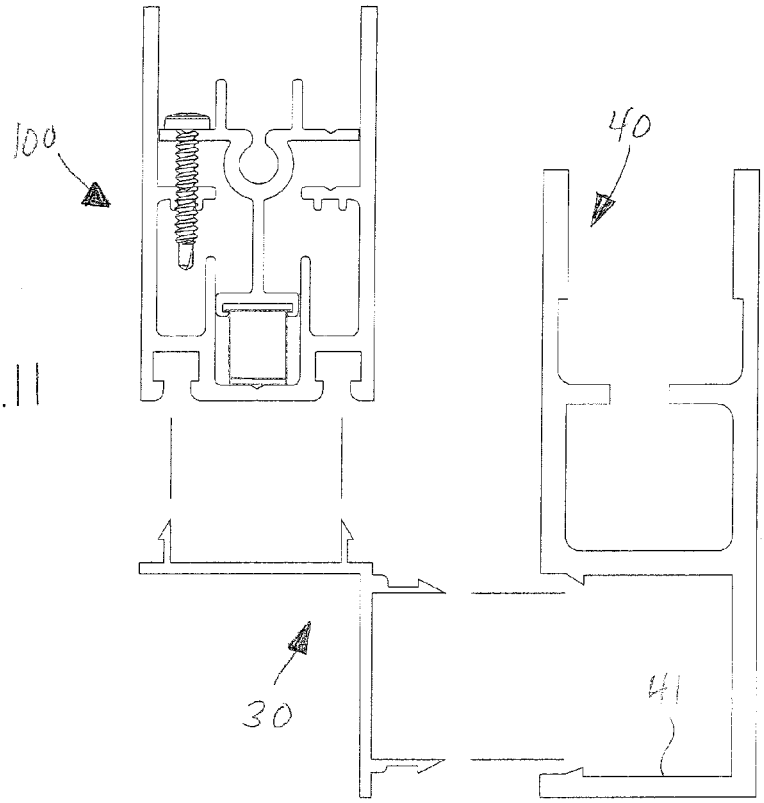
FIG. 11 is an exploded view showing the track assembly of FIGS. 5 and 6, adaptor of FIGS. 9 and 10, and an auxiliary track member.
Figure 12:
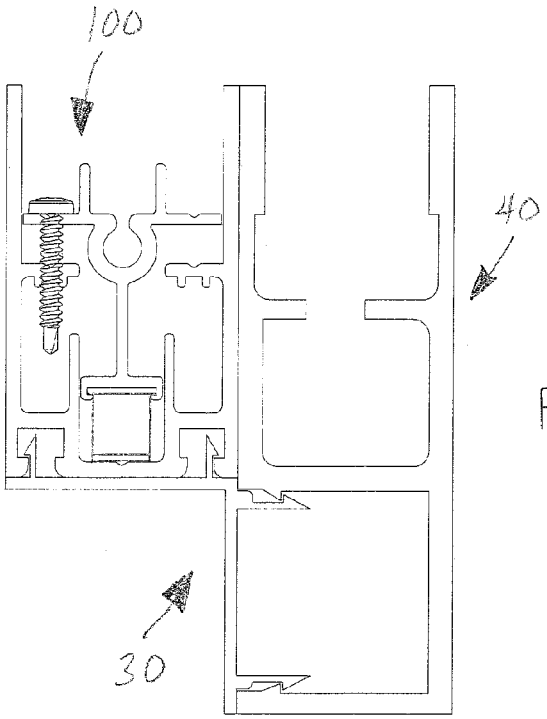
FIG. 12 shows the track assembly of FIGS. 5 and 6, adaptor of FIGS. 9 and 10 and an auxiliary track member in an assembled configuration.

The rail member 11 is preferably formed to comprise a slotted channel 14 that is sized to accept biasing or spring members 91. The biasing member 91 is preferably a leaf spring type, as shown in FIGS. 7 and 8, adapted to reside within the outer track guide channel 21 to abut the rail member 11 of the inner track member 10, as shown in FIG. 5. The embodiment of the biasing member 91 as shown comprises a widened portion defining mounting flanges 93 that are received within the slotted channel 14 of the end member 11. It is a preferred embodiment that the spring is stainless steel. With this design, the biasing members 91 exert a bias force against the inner track member 10, forcing or extending it in the direction of the opening 10 of the outer track member 20. Alternative configurations for the biasing members 91 and/or positioning of the biasing members 91 between the inner track member 10 and the outer track member 20 will also be suitable to provide the biasing force.

Adjusting fasteners 92, shown herein as a screw, serve to hold the inner track member 10 and outer track member 20 together in the desired relationship to properly tension the screen. The adjusting fasteners 92 pass through apertures provided in the mounting fins 13 of the inner track member 10 and the mounting flanges 22 of the outer track member 20, thereby securing the inner track member 10 to the outer track member 20 and limiting its inward movement toward opening 28, as shown in FIG. 6A. This combination enables the tension on the screen 60 extending between opposing track assemblies 100 to be adjusted as required to properly tension the screen 60. Tightening the adjusting fastener 92, as shown in FIG. 6B, increases tension on the screen 60 by moving the inner track member 10 further into the outer track member 20, while loosening the adjusting fastener 92, as shown in FIG. 6C, allows the biasing member 91 to push inward the inner track member 10 away from the outer face member 24 of the outer track member 20, thereby decreasing tension on the screen 60.

To mount and tension the screen 60 within an opening, the outer track members 20 are attached directly to the building by mechanical fasteners, mechanical interlocking, bonding or other suitable means. The biasing members 91 are slid into the slotted channel 14 of the inner track member 10 and the inner track members 10 are positioned in the outer track member 20. Fasteners 92 are run through holes placed on the mounting fins 13 of the inner track member 10 and through aligned holes in the mounting flanges 22 of the outer track member 20, thereby securing the assembly 100 together. The bead 61 of the screen 60 is fed into the bead channels 12 of the inner track member 10 of the track assembly 100 and the adjusting fasteners 92 are adjusted inwardly or outwardly to set the required screen tension for proper screen function and appearance.

It is contemplated that in most situations the track assembly 100 will be mounted directly to a building by mechanically fastening the outer track members 20 to the inwardly facing walls of the building opening. Alternatively, the outer track member 20 may be mounted utilizing an adaptor 30 as shown in FIGS. 9-14, either to the building, such as when the building wall has an irregular surface, or to a window frame, or to an auxiliary track member 40, such as the track of a hurricane already installed on the opening of the building. In this case a generally L-shaped adaptor member 30 is utilized, which as shown in the embodiment of FIGS. 9-12 comprises a first face 32 and a second face 33 joined at a right angle. The adapter member 30 further comprises mating flanges or catches 31 extending from the first face 32 and second face 33 to engage one or more longitudinally extending, external mating channels 23 disposed on or within the outer face 24 of the outer track member 20, and at the same time to engage one or more longitudinally extending, mating channels 41 of the auxiliary track 40.

Figure 13:
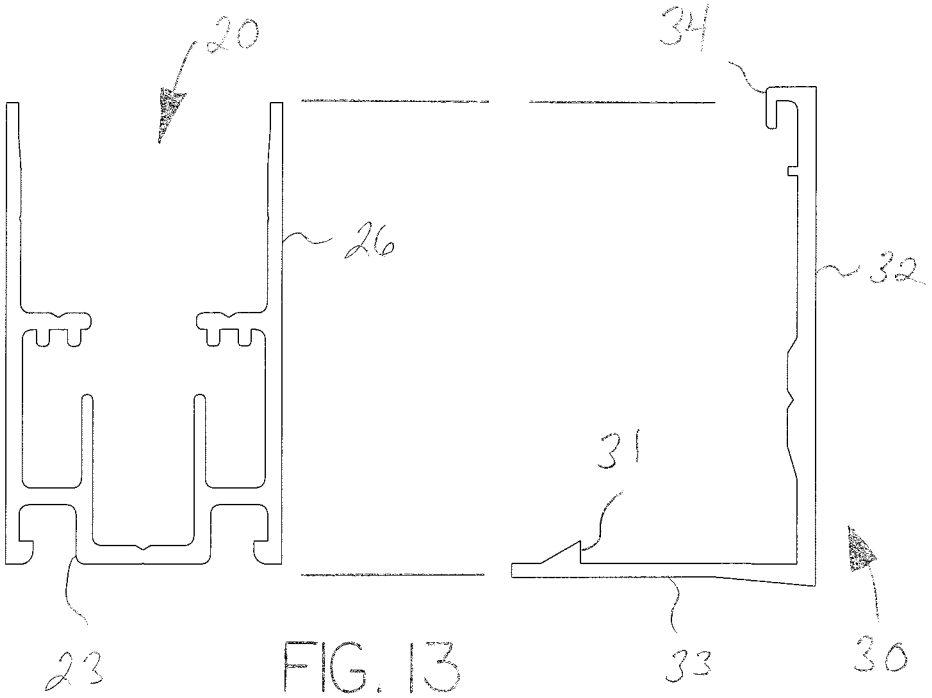
FIG. 13 is an exploded view of the outer track member and an alternative embodiment of an adaptor.
Figure 14:
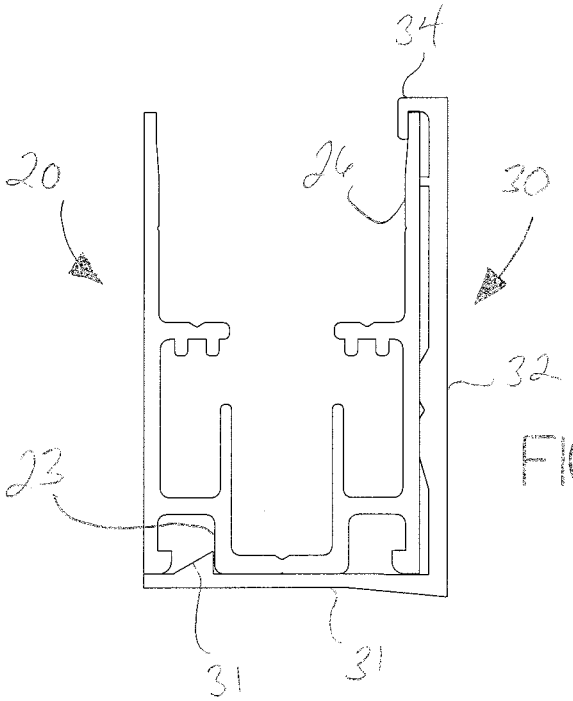
FIG. 14 shows the outer track member and the alternative adaptor embodiment of FIG. 13 in an assembled configuration.

In the alternative embodiment shown in FIGS. 13 and 14, the L-shaped adaptor 30 has a first face 32 structured to be mechanically fastened to a wall or window frame member. With the outer track member 20 affixed to the adaptor 30, the first face is in parallel with the exterior walls 26 of the outer track member 20. The second face 33, perpendicular to the first face 32, is provided with a mating flange 31 that is received by the longitudinally extending mating channel 23 on the closed end of the outer track member 20. The first face 32 is provided with a longitudinally extending hook flange 34 that receives and mates with the free edge of the abutting exterior wall 26. In this manner the adaptor 30 is first fastened to the wall or frame and the outer track member 20 is then snapped into the adaptor 30.

The extrusion profiles are of such size as to accomplish the goals of the invention. However, the profiles could be made larger or smaller, profile elements can be longer or shorter, and multiple profiles can be connected as required by the application. It is preferred that the track members 10 and 20 forming the assembly 100 and the adaptors 30 be made of extruded aluminum.

It is preferred to use common fasteners such as self-drilling screws, however any suitable type fastener may be used. It is preferred to use materials resistant to UV and other forms of degradation. While these materials and methods are preferred embodiments of the invention, other materials and methods maybe used to more efficiently produce the parts and the future may yield new materials that may enhance performance. Any of these improved items may be incorporated into the invention without altering the spirit of the invention.

The invention enables the professional installer to quickly adjust the tension of the screen track assembly inwardly or outwardly to achieve the best screen appearance and functionality and it provides the end user or homeowner the ability to make minor adjustments as required to maintain appearance and functionality with common household tools such as a screwdriver. The invention further allows the professional installer a selection of adapters that can be used to quickly attach the screen track assembly to an existing track or solve a construction irregularity.

While the invention offers a solution primarily for use in the installation of retractable screens such as insect and shade screens to protect windows and patio areas and other openings, the assembly has many other uses in many fields of endeavor where textiles screens are used; such as projector screens, temporary barriers, and billboards. Nothing should be construed from this description to limit the scope of this invention. It is understood that equivalents and substitutions for elements set forth above may be obvious to those of skill in the art, and therefore the true scope and definition of the invention is to be as set forth in the following claims.

I claim:

1. A screen track assembly adapted to mount a retractable screen across an opening, the assembly comprising: a generally U-shaped outer track member having an opening, said outer track member comprising an interior guide channel and an exterior guide channel; an inner track member received within said outer track member, said inner track member adapted to retain a retractable screen, the position of said inner track member relative to said outer track member being adjustable to adjust the tension on the retractable screen; biasing members to present a biasing force to extend said inner track member toward said opening of said outer track member; and adjustable mechanical fasteners to fix the position of said inner track member relative to said outer track member.

2. The assembly of claim 1, wherein said exterior guide channel is wider than said interior guide channel.

3. The assembly of claim 1, wherein said inner track member comprises a rail member, bead channel and mounting fins.

4. The assembly of claim 3, wherein said outer track member comprises an interior guide channel and an exterior guide channel, and wherein said rail member is positioned within said interior guide channel and said mounting fins are positioned within said exterior guide channel.

5. The assembly of claim 1, further comprising an adaptor member adapted to affix said outer track member to a building or an auxiliary track.

6. The assembly of claim 5, wherein said adaptor member is L-shaped.

7. The assembly of claim 6, wherein said outer track member further comprises mating channels, and wherein said adaptor member comprises mating flanges, said mating flanges being received within said mating channels.

8. The assembly of claim 6, wherein said outer track member further comprises mating channels and exterior walls, and wherein said adaptor member comprises a mating flange and a hook flange, said mating flange being received within said mating channel and said hook flange receiving one of said exterior walls.

9. A screen track assembly adapted to mount a retractable screen across an opening, the assembly comprising: a generally U-shaped outer track member having an opening; an inner track member received within said outer track member, said inner track member adapted to retain a retractable screen, the position of said inner track member relative to said outer track member being adjustable to adjust the tension on the retractable screen; biasing members to present a biasing force to extend said inner track member toward said opening of said outer track member; and adjustable mechanical fasteners to fix the position of said inner track member relative to said outer track member; wherein said inner track member comprises a rail member, bead channel and mounting fins; and wherein said adjustable mechanical fasteners comprise screws and extend through said mounting fins.

10. The assembly of claim 8, wherein said outer track member comprises an interior guide channel and an exterior guide channel, and wherein said rail member is positioned within said interior guide channel and said mounting fins are positioned within said exterior guide channel.

11. A screen track assembly comprising: a generally U-shaped outer track member comprising an outer face member, two parallel exterior walls, an opening and mounting flanges extending from said exterior walls; an inner track member positioned within said outer track member, the position of said inner track member within said outer track member being adjustable, said inner track member comprising a bead channel, a pair of mounting fins, and a rail member; a screen comprising a bead, said bead being retained within said bead channel in a manner whereby said bead is axially movable within said bead channel; biasing members positioned between said inner track member and said outer track member to present a biasing force to extend said inner track member toward said opening of said outer track member; and adjustable mechanical fasteners connecting said mounting fins of said inner track member to said mounting flanges of said outer track member, whereby the combination of said biasing members and said adjustable mechanical fasteners fix the position of said inner track member relative to said outer track member in an adjustable manner to properly tension said screen.

12. The assembly of claim 11, said outer track member further comprising an interior guide channel and an exterior guide channel, wherein said rail member of said inner track member is received within said interior guide channel and said mounting fins are received within said exterior guide channel in a manner whereby lateral movement of said inner track member relative to said outer track member is restricted.

13. The assembly of claim 11, wherein said biasing members are positioned between said rail members of said inner track member and said outer face member.

14. The assembly of claim 12, wherein said biasing members are positioned between said rail members of said inner track member and said outer face member.

15. The assembly of claim 13, said rail member further comprising a slotted channel, and wherein said biasing members are positioned within said slotted channel.

16. The assembly of claim 11, wherein said bead channel of said inner track member is disposed between said rail member and said mounting fins.

17. The assembly of claim 11, further comprising an adaptor member adapted to affix said outer track member to a building or an auxiliary track.

18. The assembly of claim 17, wherein said adaptor member is L-shaped.

19. The assembly of claim 18, wherein said outer track member further comprises mating channels disposed on said outer face member, and wherein said adaptor member comprises mating flanges, said mating flanges being received within said mating channels.

20. The assembly of claim 18, wherein said outer track member further comprises a mating channel disposed on said outer face member, and wherein said adaptor member comprises a mating flange and a hook flange, said mating flange being received within said mating channel and said hook flange receiving one of said exterior walls.

* * * * *